US006138382A

United States Patent [19]

Schoesler

[11] Patent Number: 6,138,382

[45] **Date of Patent: *Oct. 31, 2000**

[54] FLUID FILLED INSOLE

[76] Inventor: Henning R. Schoesler, c/o Famiview Schoesler Hopteup, Hovegade 77, DK-6100 Haderslev, Denmark

[ * ] Notice: This patent is subject to a terminal disclaimer.

[21] Appl. No.: 09/264,447

[22] Filed: Mar. 8, 1999

Related U.S. Application Data

[63] Continuation-in-part of application No. 08/687,787, Jul. 19, 1996, Pat. No. 5,878,510, which is a continuation-in-part of application No. 08/047,685, Apr. 15, 1993, abandoned.

[30] Foreign Application Priority Data

| | | | |
|---|---|---|---|
| Apr. 15, 1994 | [AU] | Australia | 94667-66 |
| Apr. 15, 1994 | [CA] | Canada | 2160587 |
| Apr. 15, 1994 | [EP] | European Pat. Off. | 94 914 349 |

[51] Int. Cl.[7] ..... A43B 13/38; A43B 7/14

[52] U.S. Cl. ..... 36/43; 36/71; 36/88; 36/153

[58] Field of Search ..... 36/43, 44, 71, 36/28, 29, 88, 93, 114, 153

[56] References Cited

U.S. PATENT DOCUMENTS

| | | | |
|---|---|---|---|
| D. 246,486 | 11/1977 | Nickel . | |
| D. 255,060 | 5/1980 | Okazawa . | |
| 1,069,001 | 7/1913 | Guy | 36/29 |
| 1,093,608 | 4/1914 | Delaney . | |
| 1,148,376 | 7/1915 | Gay . | |
| 1,193,608 | 8/1916 | Poulson . | |
| 1,304,915 | 5/1919 | Spinney . | |
| 1,781,715 | 11/1930 | Blakely . | |
| 2,080,469 | 5/1937 | Gilbert . | |
| 2,080,499 | 5/1937 | Nathansohn | 36/29 |
| 2,488,382 | 11/1949 | Davis . | |
| 2,502,774 | 4/1950 | Alianiello . | |
| 2,917,844 | 12/1959 | Scholl . | |
| 3,765,422 | 10/1973 | Smith | 36/29 |
| 3,795,994 | 3/1974 | Ava . | |
| 3,871,117 | 3/1975 | Richmond et al. | 36/29 |
| 3,892,077 | 7/1975 | Wolstenholme et al. . | |

(List continued on next page.)

FOREIGN PATENT DOCUMENTS

| | | |
|---|---|---|
| 27666/84 | 12/1984 | Australia . |
| 3629331A1 | 3/1988 | Germany . |
| 1-126905 | 5/1989 | Japan . |

OTHER PUBLICATIONS

Pittsburgh Plastics Manufacturing fluid filled insole which was believed to have been comercially introduced and sold in or about Mar. 1993.

*Primary Examiner*—M. D. Patterson

[57] ABSTRACT

A fluid filled insole wherein the flow of fluid is matched to the anatomical structure of functionally normal feet comprises a fluid tight bladder having upper and lower layers and a generally foot-shaped, planar configuration, with proximal forefoot, midfoot and hindfoot regions; a heavy, viscous, sterile liquid substantially filling the bladder; at least one, preferably between two and six transversely spaced forefoot flow deflectors joining the upper and lower layers in the proximal forefoot region of the bladder; flow passages matched to the anatomical structure of the foot between the forefoot flow deflectors and the medial and lateral and peripheral margins of the bladder; and two transverse walls, one in the proximal end of said proximal forefoot region and the other in the distal end of the hindfoot region, each transverse wall having an opening forming a longitudinal passageway. Alternatively, the walls may be viewed as two pairs of flow restrictors; one pair of restrictors in the proximal end of the proximal forefoot region and the other pair in the distal end of the hindfoot region, each pair of restrictors defining a longitudinal flow channel there between. Also included is an elongated flow restrictor in the arch region. A second embodiment has two elongated flow controllers extending from the proximal forefoot region to the distal hindfoot region, the controllers substantially underlying the medial and lateral longitudinal arches.

10 Claims, 2 Drawing Sheets

U.S. PATENT DOCUMENTS

| | | | |
|---|---|---|---|
| 3,922,801 | 12/1975 | Zente . | |
| 3,990,457 | 11/1976 | Voorhees . | |
| 4,100,686 | 7/1978 | Sgarlato et al. . | |
| 4,115,934 | 9/1978 | Hill . | |
| 4,123,855 | 11/1978 | Thedford | 36/44 |
| 4,183,156 | 1/1980 | Rudy . | |
| 4,217,705 | 8/1980 | Donzis . | |
| 4,219,945 | 9/1980 | Rudy . | |
| 4,297,797 | 11/1981 | Meyers . | |
| 4,336,661 | 6/1982 | Medrano . | |
| 4,471,538 | 9/1984 | Pomeranz et al. | 36/43 |
| 4,472,890 | 9/1984 | Gilbert . | |
| 4,567,677 | 2/1986 | Zona . | |
| 4,590,689 | 5/1986 | Rosenberg . | |
| 4,602,442 | 7/1986 | Revill et al. . | |
| 4,799,319 | 1/1989 | Zellweger . | |
| 4,845,861 | 7/1989 | Moumdjian . | |
| 4,934,070 | 6/1990 | Mauger . | |
| 4,934,072 | 6/1990 | Fredericksen et al. . | |
| 5,067,255 | 11/1991 | Hutcheson . | |
| 5,097,607 | 3/1992 | Fredericksen . | |
| 5,295,314 | 3/1994 | Moumdjian | 36/29 |
| 5,313,717 | 5/1994 | Allen et al. | 36/29 |
| 5,335,382 | 8/1994 | Huang | 36/29 |
| 5,406,719 | 4/1995 | Potter . | |
| 5,878,510 | 3/1999 | Schoesler | 36/43 |

FLUID FILLED INSOLE

CROSS REFERENCE

This application is a continuation-in-part of application Ser. No. 08/687,787 filed Jul. 19, 1996 now U.S. Pat. No. 5,878,510, which is a continuation-in-part of application Ser. No. 08/047,685 filed on Apr. 15, 1993, now abandoned.

BACKGROUND OF THE INVENTION

The present invention is directed to therapeutic fluid filled insoles, and more particularly to insole bladders having fluid flow directing and controlling members within the bladder with the purpose of achieving improved medical benefits and directional stability to the users.

Fluid filled insoles have long been known in the art, see for example, U.S. Pat. No. 4,567,677 to James Zona, U.S. Pat. No. 4,115,934 to Hall, U.S. Pat. No. 4,123,855 to Thedford, U.S. Pat. No. 2,080,469 to Gilbert and U.S. Design Pat. No. D246,486 to John W. Nickel. Prior art insoles commonly comprise a bladder having an upper layer and a lower layer. The two layers are welded together at their marginal periphery. The bladder has a planar, foot-shaped configuration, which includes a forefoot region, a hindfoot region, and a midfoot region there between. The bladder is filled with a fluid, such as water or air. The broader technical functions of fluid filled insoles are well documented, whereas the medical benefits are only marginally documented. It is not generally known that fluid filled insoles may be designed to accomplish specific medical benefits. Two significant limitations in the prior art are: (1) the flow of liquid/fluid is not matched to the anatomical structure of the foot, and (2) the flow of fluid does not provide directional stability. The known technical functions include cushioning of the feet by a massaging action on the plantar surface of the feet due to movement of the fluid within the bladder, thus achieving comfort to the user.

The fluid filled insoles of the prior art have not been entirely satisfactory, however, in the area of providing demonstrative medical benefits, neither as a device for relieving fatigue in the lower extremities by providing pressure distribution and activation of the venous pump function nor for achieving directional stability to the user when wearing the insole. Existing prior art insoles have little or no means for: (1) controlling both the transverse and longitudinal flow, (2) the rate of fluid flow within the insole, or (3) for matching the flow of fluid to the anatomical structure of the foot. As a user walks, the user's weight is initially applied to heel, and then is transferred to the ball of the foot. This causes the fluid within the bladder to move, respectively, from the hindfoot region to the forefoot region and then back towards the hindfoot again. Further, without means for directing fluid flow anatomically within the bladder, the fluid will flow uncontrollably and thus causing directional instability to the user when wearing the insole. Without means for controlling and restricting the rate of fluid flow vis-a-vis the viscosity and density of the fluid, the feet will simply "jump through" the fluid in the insole when weight load is applied, and thus the fluid insole has little pressure distribution or massaging effect.

Some prior art devices, such as the insole of the Zona patent, have attempted to regulate flow from the hindfoot region to forefoot region and vice versa by placing flow-restricting means in the midfoot area of the bladder. These flow restricting devices are only partly effective, however, since they neither match the anatomical structure of the foot nor control the flow within the forefoot or hindfoot regions of the bladder to achieve directional stability and local pressure distribution within each of the hindfoot, midfoot and forefoot regions. In addition, the midfoot flow restricting means are not matched to the anatomical structure of the longitudinal medial arch. Matching the anatomical structure of the foot to the location, direction, quantity and duration of fluid flow fully determine therapeutic benefits, pressure distribution and directional stability.

Some prior art insoles, as shown for example in the Hall or Nickel patents have attempted to regulate fluid flow within the forefoot and hindfoot regions. But, these efforts have not been anatomically satisfactory because the fluid flow is not matched to the anatomical structure of said regions, but rather directed to the outer, medial and lateral, margins of the insole, away from the areas of the foot where fluid massaging action and pressure distribution is required when considering the physiology and anatomy of the foot.

The Thedford patent has also attempted to regulate fluid flow within the forefoot and hindfoot regions. These teachings have not been anatomically satisfactory because the fluid flow is neither adapted to the anatomical structure of the foot nor arranged in a fashion that achieves directional stability to the user during the flow of fluid within the insole. Further, the Thedford patent teaches prohibition or blocking of longitudinal flow within the bladder, redirecting the flow in a transverse direction that is not anatomical.

The Gilbert patent has attempted to regulate fluid flow by randomly dispersing flow restrictors across the entire surface of the insole, which, again, does neither match the anatomical structure of the foot nor achieve directional stability. The Gilbert patent does not specify any particular arrangement of flow restrictors or fluid flow, but teaches that the "spots" "may be disposed at any desirable location with any desirable frequency" which makes flow control indefinite. Further, the Gilbert patent permits air to shift in any direction and partly arranges flow-restricting means to block longitudinal flow, which, again, is not anatomical.

Many prior art insoles are filled with ordinary water or other fluids that not only quickly evaporate and thus significantly reduce the industrial applicability (lifetime) of the insole, but also develops bacteria and/or other microorganisms, causing the fluid to become toxic and thus environmentally unsafe. In addition, existing prior art insoles do not consider the fluid itself as a flow controlling means and thus significantly limits the therapeutic value of the insole by allowing the fluid to flow at a rate that cannot satisfactorily provide pressure distribution. The rate of fluid flow significantly influences pressure distribution.

Finally, none of the prior art insoles considers local pressure distribution within each of the midfoot, forefoot and hindfoot regions of the bladder by directing and anatomically controlling the flow of fluid within each of the midfoot, forefoot and hindfoot regions. This lacking consideration significantly limits the medical and therapeutic applications of the prior art insoles. It would be desirable to have a fluid filled insole that (i) controls and directs the fluid to match the anatomical structure of the foot and achieve directional stability to the user wearing the insole, (ii) maximizes pressure distribution to minimize peak pressures on the foot, both across the entire area of the foot and within each of the hindfoot, midfoot and forefoot regions, (iii) ensures minimum evaporation of the fluid to maximize the life time of the insole, (iv) provides a fluid that is environmentally safe, and (v) devises a fluid that functions as a flow restricting means vis-a-vis the density and viscosity of the fluid to enable maximum pressure distribution, and which otherwise overcomes the limitations inherent in the prior art.

OBJECTS OF THE INVENTION

It is an object of the invention to provide an insole that has a superior therapeutic fatigue-relieving effect by providing maximum pressure distribution in each of the hindfoot, midfoot and forefoot areas of the plantar surface of the user's foot, while improving the muscular venous pump function by means of the flow of fluid interacting with foot movements.

It is a further object of the invention to provide a fluid filled insole wherein the fluid flow matches the anatomical structure of functionally normal feet; the fluid being directed and controlled in transverse and longitudinal flow passages that are adapted to the anatomical structure of functionally normal feet, thereby achieving directional stability for the user when wearing the insole.

It is another object of the invention to provide a liquid filled insole that increases the weight bearing surface area of the user's foot by improving the distribution of the user's weight both over the total area of the foot and within each of the hindfoot, midfoot and forefoot regions, thereby reducing peak pressures on the plantar surface of the user's foot.

It is a fourth object of the invention to provide an insole filled with a sterile, non-toxic, non-greasy fluid that not only has low evaporation rates but also remains environmentally safe during the entire lifetime of the insole.

It is a fifth object of the invention to provide a liquid filled insole that is durable and not prone to lose fluid by leakage, evaporation or diffusion, thus prolonging the lifetime of the insole.

It is a sixth object of the invention to provide a fluid filled insole that increases the weight bearing surface within each of the forefoot, midfoot and hindfoot regions by (i) restricting the flow of liquid between the three regions and by (ii) anatomically directing and controlling the liquid within each of the regions (local pressure distribution).

It is an eighth object of the invention to provide a fluid filled insole that accumulates anatomically optimal quantities of liquid within each of the hindfoot and forefoot areas to enable optimal pressure distribution.

SUMMARY OF THE INVENTION

The insole of the invention comprises a fluid tight bladder having an upper layer of flexible material and a lower layer of flexible material sealingly joined together at their peripheral margins. The bladder has a generally foot shaped planar configuration, with a proximal forefoot region, a hindfoot region, and a midfoot region there between. The bladder is filled with a large molecular, non-evaporable, highly viscous, sterile liquid, preferably a mixture of hygroscopic, polyvalent alcohol and distilled water. Within the proximal forefoot region of the bladder is positioned, optimally between one and five flow deflectors, the imaginary longitudinal centerlines of which are substantially equally spaced transversely one from the other, and spaced from the medial and lateral margins of the bladder. The flow deflectors comprise weld points joining the upper and lower bladder layers. Substantially equally dimensioned longitudinal flow channels are formed between the flow deflectors and between the flow deflectors and medial and lateral margins of the bladder. However, it should be understood that flow deflectors while desirable are not strictly needed.

The hindfoot region of the bladder optionally comprises between one and five hindfoot flow defectors. At least two longitudinal channels are formed between the hindfoot flow deflector(s) and the medial and lateral margins of the bladder. If two or more are so used, at least one longitudinal hindfoot flow channel is formed between the hindfoot deflectors. Thereby, fluid flowing within the hindfoot and forefoot regions and from these regions into the midfoot region and vice versa will be channeled through the longitudinal flow channels in the forefoot and hindfoot regions in a controlled fashion, resulting in enhanced medical and therapeutic benefits as explained below. It should be recognized, however, that the hindfoot flow deflectors are optional, and are not strictly required. This must be viewed in combination with the means for controlling fluid flow into and out of the hindfoot region.

In accordance with the present invention there are two alternative structures bridging the proximal forefoot region and the distal hindfoot region. A first embodiment is characterized by two transverse walls, preferably ovally formed, one in the proximal end of the proximal forefoot region, and the other in the distal end of the hindfoot region. Each wall has at least one opening, preferably one at the midpoint, forming a substantially straight longitudinal channel through which the fluid can flow from the proximal forefoot region and into the midfoot region, from the midfoot region to the hindfoot region and vice versa.

A second embodiment is characterized by two elongated flow controllers extending from the proximal forefoot region to the distal hindfoot region. One controller substantially underlies the wearer's medial arch and the other substantially underlies the wearer's lateral arch. A substantially straight longitudinal channel is formed in between the two flow controllers, through which liquid flows from the proximal forefoot region through the longitudinal arch channel and into the hindfoot region. The lateral flow controller forms a volume under the lateral arch that is not filled with liquid. The medial flow controller, however, has an opening that allows liquid from the proximal forefoot region to flow into the medial longitudinal arch area. Thereby, liquid may accumulate within the area of the medial longitudinal arch. Thus, liquid may flow from the proximal forefoot region through both the longitudinal channel between the two elongated flow restrictors and through the opening between the arch and proximal forefoot region. In use, a liquid pad or pillow is formed that substantially underlies the anatomical structure of the medial longitudinal arch region of a normal foot. In the second embodiment, flow deflectors may optionally be provided in the forefoot or heel regions, but are not strictly required.

The bladder is filled with a large molecular, non-evaporable, highly viscous, sterile liquid, preferably a mixture of hygroscopic, polyvalent alcohol and distilled water. The fluid has a viscosity and density of at least 1.10 times that of ordinary water. I refer to this as a "heavy liquid." For the above reasons, the density of the fluid, measured by g/m3, is higher than the density of water (density=weight), because a higher weight of the fluid (compared to water) restricts the rate of fluid flow. For the same reasons, the thickness (viscosity) is also higher than water, because a higher thickness of the fluid (compared to water) restricts the rate of fluid flow. This mixture is sterile, non-toxic and resistant to contamination by bacteria or other microorganisms, thereby ensuring an environmentally safe fluid within the insole. Further, the mixture of hygroscopic, polyvalent alcohol and distilled water is not susceptible to evaporation or diffusion through the bladder layers. It is also autoclavable. In the event of a bladder puncture, the liquid may be easily removed from clothing and footwear, as the mixture is also relatively non-greasy.

The insole of the invention has been tested and found to provide several desirable medical benefits. The insole relieves fatigue during prolonged standing or walking by distributing the user's weight anatomically over the area of the foot. The weight bearing surface area of the wearer's feet is increased, thereby reducing peak pressures exerted on the plantar surface of the user's foot and resulting deformation of soft tissue. The reduction in pressure thereby further relieves stress on the bones of the foot that can cause foot pain, hard skin and in extreme situations, ulceration.

Second, when interacting with the feet during locomotion, the anatomically controlled flow of fluid through the bladder across the plantar surface of the user's feet provides a therapeutic movement of the small intrinsic muscles of the feet. The movement of the muscles animates the venous pump function increasing blood circulation, which in turn improves transport of oxygen and nutrients to the cells in the foot and removal of waste products excreted from the cells.

Third, the specific locations of the flow deflectors and restrictors/controllers enable a fluid flow that is matched to the anatomical structure of the foot and thus aid in anatomically correct locomotion. This in turn provides not only directional stability during locomotion when the fluid moves within the insole, but also alleviates the foot abnormalities over supination and over pronation found in asymmetric feet.

Other attributes and benefits of the present invention will become apparent from the following detailed specification when read in conjunction with the accompanying drawings.

DETAILED DESCRIPTION

Figure 1:
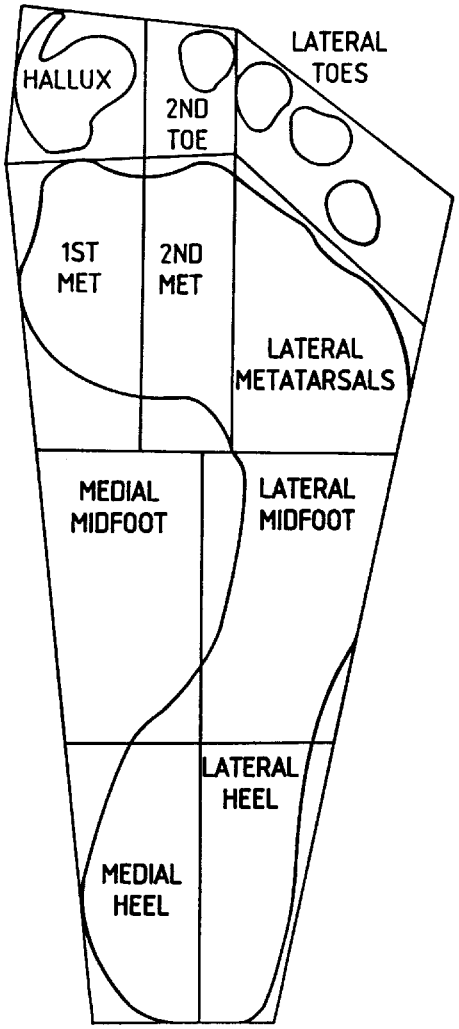
FIG. 1 is a plan view of the human foot illustrating the medial and lateral portions thereof, and shows a typical weight pressure distribution pattern of a normal foot.
Figure 2:
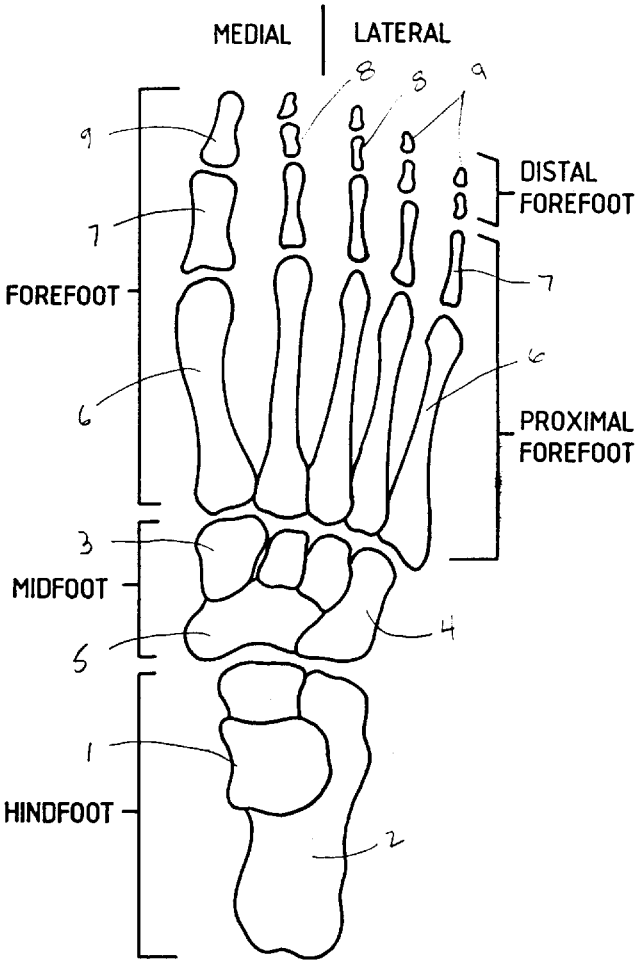
FIG. 2 is a dorsal view of the bones of the human foot.

Turning now to the drawings, FIGS. 1 and 2 illustrate the anatomical structure of the human foot. The foot comprises a (i) hindfoot region containing the talus 1 and os calcis 2 bones; (ii) a midfoot region containing the cuneiform 3, cuboid 4 and navicular 5 bones; and the forefoot region comprising the metatarsals 6, the proximal phalanges 7, and the middle 8 and distal 9 phalanges. The forefoot region can be divided into two sub-regions, the distal sub-region comprising the middle and distal phalanges, and the proximal forefoot region, which comprises the metatarsals and proximal phalanges. The foot also includes a longitudinal arch, having a medial and a lateral side. The medial longitudinal arch is defined by the navicular and medial cuneiform bones of the midfoot and the about the proximal half of the first, second and third metatarsals. The typical weight bearing area of a normal foot appears from FIG. 1. The weight is not equally distributed over the plantar area of the foot. In a functionally normal foot, the medial midfoot typically bears little weight.

Figure 3:
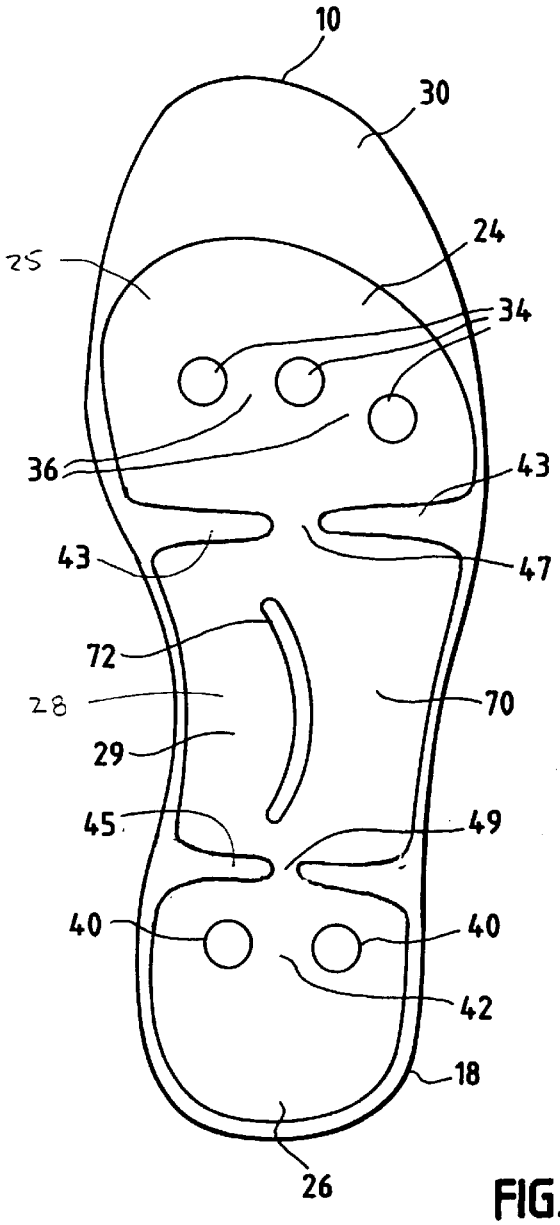
FIG. 3 is a plan view of a first embodiment of the invention.

In FIG. 3, a first embodiment of the fluid filled insole of the invention is shown. The insole comprises a bladder 10 having an upper layer 12 and a lower layer 14. The insole preferably further includes a layer of textile or a sweat absorbing material 16 substantially covering and laminated to the outer surface of upper layer 12. Optionally a textile layer could be added to the bottom surface of the insole. The bladder layers 12 and 14 are sealing joined at their peripheral margins 18. For reference, the medial peripheral margin is numbered 20 and the lateral peripheral margin is numbered 22. The bladder comprises three main regions, namely a forefoot region 25, a hindfoot region 26 and a midfoot region 28 there between. The forefoot region is divided into a distal subregion 30 and a proximal forefoot region 24.

The interior cavity 32 of the bladder 10 is filled with a sterile, non-toxic, non-evaporable fluid with a density and viscosity of at least 1.10 times that of water. The fluid is preferably a "heavy liquid" mixture of large molecular, hygroscopic polyvalent alcohol and distilled water, as is more fully described below. In the first embodiment the fluid may flow between and throughout the proximal forefoot, midfoot and hindfoot regions. The distal forefoot sub-region 30 preferably does not contain fluid. Within the proximal forefoot region 24 of bladder 22 there are at least one, but preferably between two and six transversely spaced flow deflectors 34. The deflectors are evenly spaced; that is, the transverse dimension from the imaginary longitudinal centerline of each deflector to the next adjacent imaginary longitudinal centerline is of substantially equal dimension. In the illustrated embodiment there are three forefoot flow deflectors 34, but, one could employ between one and six forefoot flow deflectors. The shape of the flow deflectors is preferably circular or oval, but other shapes may alternatively be used. The space between each of the imaginary longitudinal centerlines of adjacent flow deflectors and between the flow deflectors and the medial and lateral peripheral margins of the bladder forms substantially longitudinal forefoot flow passages. Each flow passage between adjacent deflectors has a substantially equal transverse dimension, Wm. By "substantially equal transverse dimension," I mean between 0.95 and 1.05 times Wm, where Wm is calculated as follows:

$$Wm=(Dm-Sm)/(Nm+1)$$

Dm is the maximum straight transverse width of the forefoot region, Sm is the sum of the transverse dimensions of the forefoot flow deflectors, and Nm is the number of forefoot flow deflectors.

The forefoot flow deflectors are arranged in a shape that laterally, medially, transversely and longitudinally matches the anatomical structure of the proximal forefoot region, the shape being for example, but not limited to, an arc, a semicircle, or a trapezoid, the convex side of the shape facing in a distal direction. The spacing between the imaginary longitudinal centerlines of the flow deflectors depends on (i) the shoe or foot size, (ii) the diameter of the flow deflectors, and (iii) the number of flow deflectors. With two forefoot flow deflectors, the spacing from imaginary longitudinal centerline to centerline between flow deflectors would be 33% or one third of the transverse straight distance between the lateral and medial peripheral margins of the bladder measured at the location of the flow deflectors. If n flow deflectors are placed in the proximal forefoot region, then n+1 longitudinal flow passages are formed.

The flow deflectors 34 are formed by weld points joining the upper bladder layer 12 to the lower bladder layer 14. Formation of flow deflectors by welding points joining the bladder layers improves the structural integrity of the bladder, improving durability. Between flow deflectors 34 are flow passages 36 through which fluid flows during use of the insole. Additional flow passages 38 are also formed in the proximal forefoot region between flow deflectors 34 and the medial peripheral margin 20, and between flow deflectors 34 and the lateral peripheral margin 22. The forefoot flow passages 36 and 38 extend in a straight, longitudinal direction. By "longitudinal" it is meant that the flow direction varies by no more than 10 degrees (plus or minus) from the straight longitudinal axis of the insole. At least one passage flows in an unobstructed path to the mid foot region of the bladder. Flow deflectors 34 are shown as being circular, but other shapes, such as oval or ellipse, may be alternatively used.

Bridging the proximal forefoot region and the midfoot region 28 of bladder 10 is a flow controller 72, which is generally matched to the wearer's arch such as depicted in FIG. 1. The arch flow controller may be configured in several different ways, but must match the contour or anatomical structure of the longitudinal arches of a normal foot, as described above in reference to FIGS. 1 and 2. The lateral edge of the longitudinal medial arch is generally an elongated, semicircular line substantially at the longitudinal border of the lateral and medial arch of a normal foot, such as shown in FIG. 1. The longitudinal medial arch extends from the proximal part of the midfoot area to about the mid-point of the metatarsals, as shown in FIG. 1. Flow controller 72 is shaped and located to match at least a portion of the border between the medial and lateral longitudinal arch. A midfoot flow channel 70 is formed on the lateral side of controller 72. A semi-enclosed area or volume 29 is defined by the longitudinal arch flow controller 72 and the medial peripheral margin of the bladder that substantially matches the anatomical structure of the medial longitudinal arch region of a normal foot. In this way, liquid will flow from the proximal forefoot region and into the medial arch region, thus forming a liquid pad or pillow substantially under the area of the medial arch.

The hindfoot region 26 of the insole 10 of the invention optionally includes one to five flow deflectors 40. However, such hindfoot flow deflectors are not strictly required. One could practice the invention as defined by the appended claims with no hindfoot flow deflectors. This must be viewed in combination with the overall structure of fluid flow within the insole, but specifically how fluid flow into and out of the hindfoot region is controlled. Because the hindfoot region is a smaller area than the forefoot region, two flow deflectors are shown. Alternatively, zero, one, three, four or five could be used. The hindfoot flow deflectors 40 are formed in the same manner as the forefoot flow deflectors, by a weld point joining the upper and lower bladder layers 12 and 14. At least one generally longitudinal flow passage 42 is formed between hindfoot flow deflectors 40, if two or more hindfoot deflectors are used. Additional hindfoot flow passages 44 are formed between hindfoot deflectors 40 and the medial and lateral peripheral margins of the bladder. The transverse spacing and dimensions of the hindfoot flow passages is not critical and may vary as desired.

The first embodiment, FIG. 3, comprises a communicating compartmentalized structure of the insole. Substantially transverse walls 43 and 45 are formed at the intersections of (i) the proximal part of the proximal forefoot region and the distal part of the arch region, and (ii) the proximal part of the arch region and the distal part of the hindfoot region. The transverse wall 43 in the proximal end of the forefoot region has at least one opening, preferably one at the midpoint, forming a longitudinal channel 47 through which the fluid can flow from the proximal forefoot region and into the midfoot region and vice versa. The size of the opening is between 10% and 25% of the straight distance between the lateral and medial peripheral margins measured at the location of said transverse wall. The opening is not limited to one but could be several openings. The opening is preferably placed at the midpoint on said transverse wall 43, but could be placed anywhere along said transverse wall.

Similarly, the transverse wall 45 located in the distal end of the hindfoot region has at least one opening, preferably one at the midpoint, forming a longitudinal channel 49 through which the fluid can flow from the hindfoot region and into the midfoot region and vice versa. The size of the opening is between 10% and 25% of the straight distance between the lateral and medial peripheral margins measured at the location of the transverse wall. The opening 49 is not limited to one but could be several openings. The opening is preferably placed at the midpoint of the transverse wall, but could be placed anywhere along the transverse wall. The shape of said transverse walls are preferably, but not limited to, oval or ellipse, but other shapes may be used alternatively.

The aforesaid transverse walls and openings may be alternatively viewed and described as a pair of flow restrictors placed against the lateral and medial margins of the bladder. The flow passage is formed by leaving an opening between the respective restrictors.

Figure 4:
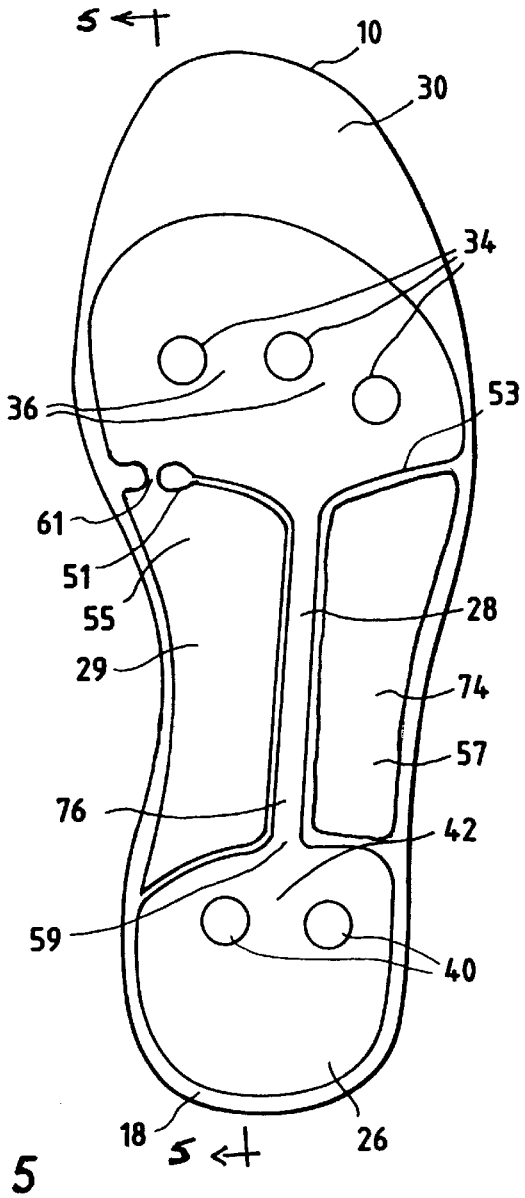
FIG. 4 is a plan view of a second embodiment of the invention.
Figure 5:
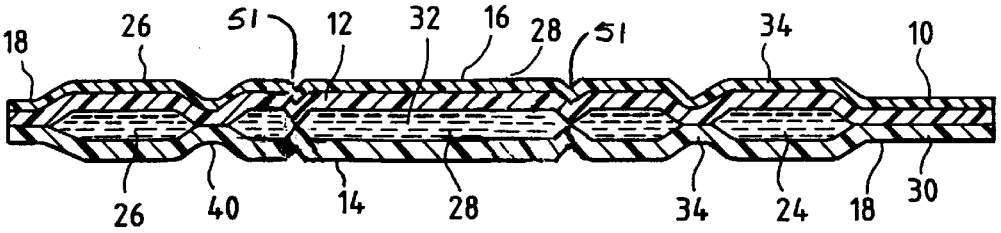
FIG. 5 is a cross-section taken along line 5—5 of FIG. 4.

FIG. 4 shows a second embodiment of the invention. The second embodiment is similar to the first embodiment with a more structured longitudinal central passageway. It is generally a communicating, semi-compartmentalized structure in which the liquid is controlled by two elongated flow restrictors 51 and 53 extending from the proximal forefoot region to the hindfoot region. Flow restrictor 51 defines a medial longitudinal arch area 55. Flow restrictor 53 defines a lateral longitudinal arch area 57. A substantially straight longitudinal channel 59 is formed between the two flow restrictors 51 and 53, through which liquid flows from the proximal forefoot region into the hindfoot region and vice versa. The lateral elongated flow restrictor 53 has one end beginning at the lateral margin of the bladder in the proximal end of the proximal forefoot region, extends substantially along the border between the lateral and medial longitudinal arches, and ends at the lateral peripheral margin of the bladder in the distal end of the hindfoot region. The lateral longitudinal arch area of the bladder is not filled with liquid. The medial elongated flow restrictor 51 has one end beginning at the medial margin of the bladder in the proximal end of the proximal forefoot region, extends substantially along the border between the lateral and medial longitudinal arches, and ends at the medial peripheral margin of the bladder in the distal end of the hindfoot region. The medial longitudinal arch area is filled with liquid.

In the lateral proximal corner of the proximal forefoot region, flow of liquid is blocked by the elongated lateral flow restrictor 53 and thus cannot flow into the lateral longitudinal arch area 57, but only through the longitudinal channel 59 between the two elongated flow restrictors. An opening 61 is made in the medial proximal corner of the forefoot region with the purpose of allowing liquid from the proximal forefoot region to flow into the medial longitudinal arch region 55. The opening is preferably in the portion of restrictor wall 51 that is in the proximal end of the proximal forefoot region. Thereby, liquid may accumulate within the medial longitudinal arch area. Liquid may also flow from the proximal forefoot region through the longitudinal channel 59 between the two elongated flow restrictors.

As compared to the first embodiment, the transverse legs of restrictors 51,53 of the second embodiment are substantially equivalent to the transverse walls 43,45 of the first embodiment. The longitudinal legs of the medial and lateral restrictors 51,53 connect the openings in the transverse legs to form channel 59. The longitudinal leg of medial restrictor 51 assists in confining fluid within the medial arch area, in much the same manner as the C-shaped controller in the first embodiment, to form a liquid pad or pillow supporting the wearer's medial longitudinal arch.

In the second embodiment, optional forefoot flow deflectors 34 and hindfoot flow deflectors 40 may be provided, but are not strictly necessary.

The bladder is preferably fabricated from polyurethane film although other thermoplastic materials, such as EVA, PVC or vinyl may also be used. The thickness of each bladder layer should be from about 300 to 800 micrometers, 400 micrometers being preferred. The sweat absorbing material is preferably about 250 micrometers in thickness. Other textile materials may be used for comfort or breathability regardless of sweat absorbing properties. The bladder may be formed by conventional radio frequency or dielectric welding techniques. Other welding techniques, such as thermal welding may be used alternatively. The bladder is filled with the liquid mixture leaving an opening in the peripheral weld, through which liquid may be introduced, then sealing the opening. The insole of the invention may be made and sold as an insole for removable placement in shoes by the user. Also, the insole may be built into footwear as a permanent feature.

The fluid used to fill the cavity 32 of the bladder 10 is preferably a mixture of distilled water and a sterile, non-toxic, non-evaporable, large molecular, hygroscopic liquid to prevent evaporation or diffusion through the bladder. Polyvalent alcohols with large molecules and with non-toxic properties are preferred. One suitable formulation comprises approximately 85–98%, hygroscopic polyvalent alcohol and approximately 2–15% distilled water. By using this mixture in lieu of plain water, improved benefits are achieved: The mixture of the invention as compared to water does not evaporate or diffuse through the bladder layers, thereby significantly improving life time and durability of the insole. The liquid can withstand autoclaving as may be required by health care institutions. The insoles can be used in temperature ranges from minus 20 degrees Celsius to plus 120 degrees Celsius, because both the liquid mixture and bladder materials can withstand these temperature extremes. The liquid is fully sterile and non-toxic, and thus environmentally safe.

The sterility and/or non-toxicness of the fluid is extremely important for several reasons. Children, people and animals could bite the insole, possibly drinking or swallowing the liquid. Water becomes septic after a few months of storage within insoles, because bacteria will grow and flourish in the water.

Compared to water, the mixture of polyvalent alcohol and distilled water has a significantly higher density and viscosity. The fluid of the invention has a preferred density and viscosity range of at least 1.10 times that of water. The actual filling of fluid with a particular density that is at least 1.10 times that of water depends on the flow controlling means within the bladder. Generally, the more the flow of liquid within the bladder is restricted by flow controlling means in the forefoot, midfoot and hindfoot regions, the lower the requirement for the density and viscosity of the liquid. Inversely, the fewer flow controlling means within the bladder, the higher the density and viscosity required. The density and viscosity of the fluid causes an improvement in the effects on the user's foot when wearing the insoles, because the density and viscosity generally controls the rate of flow of the viscous liquid within the insole. In this way, the density and viscosity strongly influence not only the degree of pressure distribution with following reduction of peak pressures on the plantar surface of the foot, but also directional stability.

The liquid used is a thick or heavy liquid that is resistant to flow, but not so thick that flow is unduly restricted. It is intended that when body weight is applied to one area of the bladder, the fluid will slowly and gradually flow out of the area after application of load over a few milliseconds of time, thus the fluid is functioning as a flow restricting means and thereby enable an improved weight pressure distribution as compared to the fluid being ordinary water. Preferably, the fluid does not leave a region before the weight load is applied to that region. Referring to FIG. 4 as an example, when a user places his/her heel to the hindfoot region the fluid will not immediately leave the region, i.e., the fluid will not "jump" out of that area upon application of load. Rather, the fluid will not flow out of the hindfoot region before after application of weight load has occurred. I refer to this as a "heavy liquid." For the above reasons, the density of said fluid, measured by g/m3, is higher than the density of water (density=weight), because a higher weight of the fluid (compared to water) restricts the rate of flow of fluid. For same reasons, the thickness (viscosity) is also higher than water, because a higher thickness of the fluid (compared to water) restricts the flow of fluid, and thus enable application of load before the fluid leaves a region.

The liquid is relatively non-greasy. Thus, if the insoles are punctured or for any reason the liquid runs out into the user's socks or shoes, the shoes and socks may be readily cleaned.

Testing has shown that there are four basic beneficial effects from wearing the insoles of the invention, namely: (1) reducing pressure on the foot; (2) improves the venous pump function by causing a movement of all the small intrinsic foot muscles; (3) symmetric walking, and (4) directional stability. Each of these therapeutic benefits will be explained in turn.

In the body, blood is pumped from the heart through the arteries out to the energy consuming muscles, where the blood carries the various energy substances such as carbohydrates and oxygen. Within the muscles, the energy is subsequently provided by an oxidation process in which carbohydrates interact with oxygen creating carbon dioxide, water and energy. If a person is working extremely hard—resulting in substantial use of muscles—the oxygen supplied to the muscles (through the blood supply) is insufficient to supply the muscles with sufficient energy. Energy may also be produced in the muscles by splitting of glycogen into lactic acid and energy. Glycogen is a substance in the muscles. The oxygen-poor blood and cell waste products that have resulted from the energy production will then be transported through the veins back to the heart and the purifying organs of the body. The veins function with the muscles to form a venous pump system that eases the transport of the blood back to the heart. The venous pump functions in cooperation with the muscle activity since the moving muscles cause the veins to stretch and contract. Since the veins internally are equipped with valves (flaps) that prevent the blood from flowing away from the heart, the muscle activity on the veins causes the veins to function as a pump system that significantly increases blood transportation back to the heart.

When an individual is standing or walking for more than four hours per day, the foot muscles may receive insufficient movement and exercise. Individual movement of the many small muscles in the foot is hindered. If the foot muscles have insufficient strength, they do not have the sustaining strength to maintain the weight of the body, and the heel bone and metatarsal bones may sink downwardly. The following chain reaction occurs:

1. When the feet collapse ("sink down"), the foot muscles are compressed, which reduces blood flow. Simultaneously, low muscle activity from the compression of the foot muscles causes a reduction of the venous pump function.

2. The foot muscles do not receive sufficient oxygen and carbohydrate quantities for maintaining adequate energy production and oxidation.

3. Because of the constant pressure and lack of supply of oxygen and carbohydrates, the foot muscles start to produce energy by splitting of glycogen to lactic acid and energy.

4. Because blood circulation is hindered, the process will accumulate lactic acid in the foot muscles.

5. Lactic acid causes fatigue, heavy legs, and later pain, depending on the length of time walking or standing.

6. The fatigue feeling tends to cause people to place themselves in inappropriate or awkward positions in an effort to remedy the feeling, again affecting other muscles, leading to pain in legs, back, head, etc.

With the insole of the invention, the movement of the liquid within the bladder will result in the user's body weight being more widely distributed over the area of the foot, thereby increasing the weight bearing surface area of the foot, and relieving peak pressures on the foot muscles. The weight is not equally distributed over the plantar surface area of the foot, see FIG. 1. Further, the simultaneous movement of fluid within the bladder causes the small intrinsic foot muscles to move, which, combined with the pressure distribution effect, improves the venous pump function and thus avoiding the above chain reaction. Tests reveal that the insole of the invention reduces peak pressures, measured by the average pressure in kilograms per square centimeter against the plantar surface of the user's foot. The improved distribution of the user's weight is particularly applicable during standing or walking. It is important to avoid high pressure on heel and metatarsal bones, since such pressure can cause foot pain, hard skin, and, in extreme situations, ulceration. These abnormalities are well known in diabetic feet.

The weight of the user pressurizes the liquid within the bladder. The pressurized liquid will constantly move the non-loaded parts of the bladder upwards. Movement or weight shift by the user will cause fluid movement, whereby a constant movement of the small internal foot muscles occurs. A considerably improved venous pump function is thereby established in the foot itself. A constant massage of the foot sole occurs for each time weight distribution is changed by the movement of the fluid within the three regions. When the feet, and thus the weight, is placed on the insoles, a weight pressure redistribution action takes place between the feet and the insoles, stimulating the blood veins. The effect is a considerably improved venous pump function, which is obviously very important for any person participating in a standing, walking or running activity. The function of the blood is to transport oxygen and nutrients to the cells, and return waste products to be excreted from the user's kidneys, through the urine. Improved blood circulation will decrease the amount of lactic acid, an element known as causing fatigue or myasthenia. Blood circulation is thus very important to individuals applying their muscles extensively, since muscle exertion constrains the blood corpuscles, thus hampering the transport of nutrients and waste products. Another effect of insufficient blood supply is a reduction of the contraction ability of the muscles. The fluid filled insole of the invention enhances the location, degree and duration of beneficial pressure distribution as compared to the prior art vis-a-vis the flow of fluid that is specifically matched to the anatomical structure of the foot (FIGS. 1 and 2). A positive effect is a reduction and in many instances elimination of the painful effect of soreness in feet, legs, and back caused by prolonged standing or walking.

The features that distinguish the current invention from the prior art is further the specific location of the flow deflectors and restrictors in the forefoot, midfoot and hindfoot regions, enabling a flow of fluid matched to the anatomical structure of the feet. The flow deflectors and restrictors and their following flow passages ensure directional stability during locomotion by enabling a controlled circulation of liquid that is matched to the anatomical structure of the normal foot. This is important since uncontrolled liquid circulation would result in unstable walking, unstable weight distribution, discomfort, and potentially the development of foot abnormalities. Directional stability, as achieved by the designed liquid circulation of the invention and as distinguishable over the prior art, ensures an anatomical locomotion pattern for the wearer, because the weight is anatomically distributed on the surface area of the foot. The insole can alleviate the problems involved in over-supination and over-pronation, i.e., where the user's feet are turning abnormally either to the medial, inner side or the lateral, outer side of the foot ("asymmetric feet"). The combination of distribution of weight pressure and directionally stabilizing fluid circulation also supports a functionally correct take-off; a factor crucial for walking or running in a physiologically correct manner.

While the preferred embodiment of the present invention has been shown and described, it is to be understood that various modifications and changes could be made thereto without departing from the scope of the appended claims.

What is claimed is:

1. An improved insole to be adapted to underlie the anatomical structure of the wearer's foot, the foot having a lateral longitudinal arch, a medial longitudinal arch and a longitudinal border there between, said insole of the type in which a bladder is filled with a fluid, said bladder having a generally foot-shaped configuration with a proximal forefoot region, a hindfoot region and a midfoot region there between, wherein the improvement comprises:

at least one but no more than six transversely spaced flow deflectors in the proximal forefoot region of said bladder, said deflectors being spaced apart relative to one another;

at least two, but no more than seven forefoot flow passages between each of said flow deflectors and between said flow deflectors and the lateral and medial margins of the proximal forefoot region of said bladder, said forefoot flow passages having substantially equal transverse dimension;

a transverse wall in the proximal end of the proximal forefoot region, said transverse wall extending transversely from the lateral and medial peripheral margins, and having at least one opening therein to allow fluid to flow from the proximal forefoot region to the midfoot region of said bladder;

an elongated flow controller bridging the forefoot and midfoot regions of said bladder, the elongation of said flow controller substantially matching at least a portion of said longitudinal border between the medial longitudinal arch and the lateral longitudinal arch of the wearer's foot, said fluid comprising a heavy viscous liquid.

2. An improved insole as in claim 1, further comprising:

a transverse wall in the distal end of the hindfoot region of said bladder, said transverse wall extending transversely from the lateral and medial peripheral margins, and defining at least one opening therein to allow fluid to flow from the hindfoot region to the midfoot region and vice versa.

3. An improved insole as in claim 2, further comprising a longitudinal channel between said opening in said proximal forefoot wall and said opening in said hindfoot wall, whereby said channel conveys fluid from said forefoot region to said hindfoot region, and vice versa.

4. An improved insole as in claim 3, the foot having a lateral longitudinal arch, a medial longitudinal arch and a longitudinal border there between, wherein said forefoot wall, longitudinal channel and hindfoot wall define a medial longitudinal arch area substantially underlying the wearer's medial longitudinal arch and extending substantially from the medial peripheral margin of the proximal forefoot region, substantially along at least a portion of the border between the wearer's medial and lateral longitudinal arches, to the medial peripheral margin of the hindfoot region, and a lateral longitudinal arch area substantially underlying the wearer's lateral longitudinal arch and extending substantially from the lateral peripheral margin of the proximal forefoot region, substantially along at least a portion of the border between the wearer's medial and longitudinal arches, to the lateral peripheral margin of the hindfoot region, said lateral longitudinal arch area being substantially free of liquid, a substantially longitudinal flow channel between said medial and lateral longitudinal arches, said longitudinal flow channel conveying fluid from the proximal forefoot region to the hindfoot region and vice versa.

5. An improved insole as in claim 4, further comprising a opening into said medial longitudinal arch area within said bladder whereby fluid may flow into said medial area.

6. An improved insole as in claim 1, further comprising at least one flow deflector in the hindfoot region of said bladder, and at least two substantially longitudinal hindfoot flow passages between said at least one hindfoot flow deflector and said lateral and medial margins of said bladder, each of said hindfoot flow passages having substantially equal transverse dimension, and at least one of said hindfoot flow passages extending from the hindfoot region to the midfoot region of said bladder.

7. An improved insole as in claim 1, wherein said insole is incorporated into footwear.

8. An insole adapted to underlie the anatomical structure of the wearer's foot, the foot having a lateral longitudinal arch, a medial longitudinal arch and a longitudinal border there between, comprising a lower layer of substantially impermeable, flexible material;

an upper layer of substantially impermeable, flexible material;

said upper and lower layers being sealingly joined to one another at their peripheral margins, said upper and lower layers forming a substantially fluid tight bladder, said bladder having a generally planar, foot-shaped configuration having distal forefoot region, a proximal forefoot region, a hindfoot region and a midfoot region there between;

at least one but no more than six transversely spaced forefoot flow deflectors between said upper material layer and said lower material layer in said proximal forefoot region;

forefoot flow passages between said forefoot flow deflectors and between said forefoot flow deflectors and the medial and lateral margins of said bladder, each said forefoot flow passages having a substantially equal transverse dimension;

a transverse forefoot wall at the proximal end of said forefoot region, said forefoot wall extending from the lateral peripheral margin to the medial peripheral margin of said bladder, said transverse forefoot wall having at least one opening therein, said opening defining a longitudinal flow channel between said forefoot and said midfoot regions of said bladder;

an elongated flow controller bridging the forefoot and midfoot regions of said bladder, the elongation of said flow controller substantially matching at least a portion of the longitudinal border between the medial longitudinal arch and the lateral longitudinal arch of the wearer's foot, said arch flow controller for directing flow from said hindfoot region to said forefoot region and vice versa, a transverse hindfoot wall at the distal end of said hindfoot region, said hindfoot wall extending from lateral peripheral margin to the medial peripheral margin of said bladder, said hindfoot wall having at least one opening therein, said opening defining a longitudinal flow channel between said hindfoot and said midfoot regions of said bladder a liquid within said bladder, said liquid flowable from said hindfoot region to said proximal forefoot region and vice versa, and said distal forefoot region being substantially liquid free.

9. An insole as in claim 8, wherein said liquid is a sterile, heavy liquid.

10. An improved insole adapted to be worn beneath a wearer's foot, said insole of the type in which a bladder is filled with a fluid, said bladder having a generally foot-shaped configuration with a proximal forefoot region, a hindfoot region and a midfoot region there between, wherein the improvement comprises:

at least one but no more than six transversely spaced flow deflectors in the proximal forefoot region of said bladder, said deflectors being spaced apart relative to one another;

at least two, but no more than seven forefoot flow passages between each of said flow deflectors and between said flow deflectors and the lateral and medial margins of the proximal forefoot region of said bladder, said forefoot flow passages having substantially equal transverse dimension;

a medial flow restrictor in said bladder defining an area underlying the wearer's medial longitudinal arch and extending from the medial peripheral margin in the proximal end of the proximal forefoot region of said bladder, substantially along the border between the wearer's medial and lateral longitudinal arch, to the medial peripheral margin in the distal end of the hindfoot region of said bladder, said flow restrictor having an opening therein to allow fluid to accumulate within said medial flow restrictor underlying the wearer's medial longitudinal arch;

a lateral flow restrictor in said bladder underlying the wearer's lateral longitudinal arch, and extending from the lateral peripheral margin in the proximal end of the proximal forefoot region of said bladder, substantially along the border between the wearer's lateral and medial longitudinal arch, to the lateral peripheral margin in the distal end of the hindfoot region of said bladder, said lateral flow restrictor being substantially free of liquid;

a longitudinal flow channel between said medial and lateral flow restrictors, said longitudinal flow channel conveying fluid from the proximal forefoot region to the hindfoot region and vice versa; and said fluid comprising a heavy, viscous liquid.

* * * * *